US005584130A

United States Patent [19]

Perron

[11] Patent Number: 5,584,130

[45] Date of Patent: Dec. 17, 1996

[54] THERAPEUTIC AND INSULATING INSOLE

[76] Inventor: Maurice Perron, 3231 Rue Du Versant-Nord, Ste-Foy, Quebec, G1X 3V5, Canada

[21] Appl. No.: 363,361

[22] Filed: Dec. 23, 1994

[51] Int. Cl.[6] ..... A43B 13/40; A43B 7/06

[52] U.S. Cl. ..... 36/44; 36/3 B

[58] Field of Search ..... 36/44, 3 B, 30 R, 36/2.6, 140

[56] References Cited

U.S. PATENT DOCUMENTS

| | | | |
|---|---|---|---|
| 2,641,068 | 6/1953 | Thompson | 36/44 |
| 2,677,906 | 5/1954 | Reed | 36/44 |
| 2,736,109 | 2/1956 | Scholl | 36/44 |
| 3,170,250 | 2/1965 | Scholl | 36/3 B |
| 3,253,601 | 5/1966 | Scholl . | |
| 4,658,515 | 4/1987 | Oatman | 36/2.6 |
| 4,999,931 | 3/1991 | Vermeulen . | |
| 5,388,349 | 2/1995 | Ogden | 36/44 |
| 5,465,508 | 11/1995 | Bourdeau | 36/44 |

FOREIGN PATENT DOCUMENTS

| | | | |
|---|---|---|---|
| 505416 | 8/1954 | Canada . | |
| 452576A1 | 10/1991 | European Pat. Off. . | |
| 969914 | 12/1950 | France . | |
| 474016 | 3/1929 | Germany | 36/3 B |
| 595976 | 4/1934 | Germany | 36/3 B |
| 19210 | 4/1983 | Japan . | |
| 227135 | 8/1968 | Switzerland . | |

OTHER PUBLICATIONS

Rodgers & Co. Poron, 1986, 7 pages.

*Primary Examiner*—Ted Kavanaugh

[57] ABSTRACT

The invention pertains to an improved insole that combines insulating and therapeutic properties. The insole consists of a sandwich of several materials, namely a mesh that is adapted to rest on the bottom of some footwear, an aluminum foil whose shiny face is fixed with an adhesive onto the top face of the mesh. A polyethylene film laminated against the dull face of the aluminum foil also serves as the external face of an air bubble sandwich made out of one or two rows of air cells, separated from each other by a central polyethylene film, and covered by another polyethylene film. A second aluminum foil has its dull face laminated against a polyethylene film, and a mesh is then fixed on the shiny surface of the aluminum film with an adhesive. Finally, a resting strip for a foot is then fixed, by adhesive, to the top of the mesh.

18 Claims, 3 Drawing Sheets

THERAPEUTIC AND INSULATING INSOLE

BACKGROUND-FIELD OF THE INVENTION

This invention relates to insoles, specifically to such insoles that have therapeutic uses and insulate one's foot.

BACKGROUND-DESCRIPTION OF PRIOR ART

A certain number of insoles are presently on the market and the following patents have been found of interest:

SHO 19201 Kieren, 4 Feb. 1983, which illustrates an insole comprising: a row of isolated air cells which are covered by a protective lining on its internal and external sides. This insole does not insulate the foot well against the cold and humidity over a long period of use. The insole will flatten very rapidly because it is not very thick.

SW 227,135 Olsson, 5 Aug. 1968, which illustrates an insole comprising a number of different density foam layers and a thin layer of metal mesh on its superior face.

EP 0,452,576,A1 Chen, 18 Apr. 1990, which illustrates a number of laminated air cell layers having a film between each of the air cell layers. Certain films may be made of metal and some layers of air cells may be connected to each other. This invention possesses an aluminum coating on the inside but does not provide aeration means on the surface of the insole.

U.S. Pat. No. 4,999,931 Vermeulen, 19 Mar. 1991, which illustrates a system to absorb shocks in an insole. The invention reveals air cells "drowned" in a polymer or a foam which, by their density, absorb a big portion of the shocks, but do not repell humidity very efficiently.

U.S. Pat. No. 3,253,601 Scholl, 31 May 1966, which illustrates an insole made of a number of layers of different density foams having open cells. This insole has the undesired effect of compressing itself with time and offering minimal shock absorption.

CN 505,416 Mainville, 21 Mar. 1953, which illustrates an insole made out of a polymer and made only of interlaced filaments and forming a net. This method does not absorb shocks and does not have insulating capabilities.

FR 969,914 Interrub 31 May 1950, which illustrates an insole made out of different layers of foam where one is porous and adapted to absorb shocks. This insole offers insulation but requires a wide thickness.

One also finds a material of the Rogers company named PORON 4000 which is a urethane type foam that has a variable porosity. The cells of the material are open which allows the material to breath. The material by itself offers a cushion of various hardness values according to composition but used alone, it does not provide adequate insulation.

OBJECTS AND ADVANTAGES

Accordingly, besides the objects and advantages of the therapeutic and insulating insole described in my present patent, several objects and advantages of the present invention are:

(a) a better absorption of shocks on the foot;

(b) a better support of the foot because some of the air cells are compressed so the insole takes the form of the foot;

(c) a better insulating capability because of the combination of aluminum coating and air cells;

(d) a better therapeutic insole for people having problems with sweating feet and a better blood circulation because of the reflective effect of the aluminum film. The foot muscles get dilated, which permits a better blood circulation and at the same time reduces numbness and pain in the foot and the legs.

A primary objective and more specific object of the invention is to provide a cushion that adapts to the foot and comprises openings that permit the passage of energy emissions coming from the foot, a reflective aluminum film adapted to the base of the cushion and allowing the reflection of energy through the openings and back toward the foot. The presence of a mesh between the cushion and the aluminum film allows a certain space which gives a better reflective effectiveness by the aluminum film and reinforces the air cushion so as to prolong its life.

A second objective is to provide a means of air cells attached to the aluminum film which give a cushion to absorb shocks so that the air cells do not collapse under the pressure exerted by the foot. The air cells comprise a polyethylene film welded to the aluminum film on its dull surface.

A third objective is to provide a reflective means adapted to the air cells and comprising an aluminum film which possesses a reflective side which radiates the energy emissions coming from a footwear sole, back to the footwear sole and keeping the foot at an appropriate temperature.

Still further objects and advantages will become apparent from a consideration of the ensuing description and drawings.

DRAWING FIGURES

In the drawings, closely related figures have the same number.

DESCRIPTION

Figure 1:
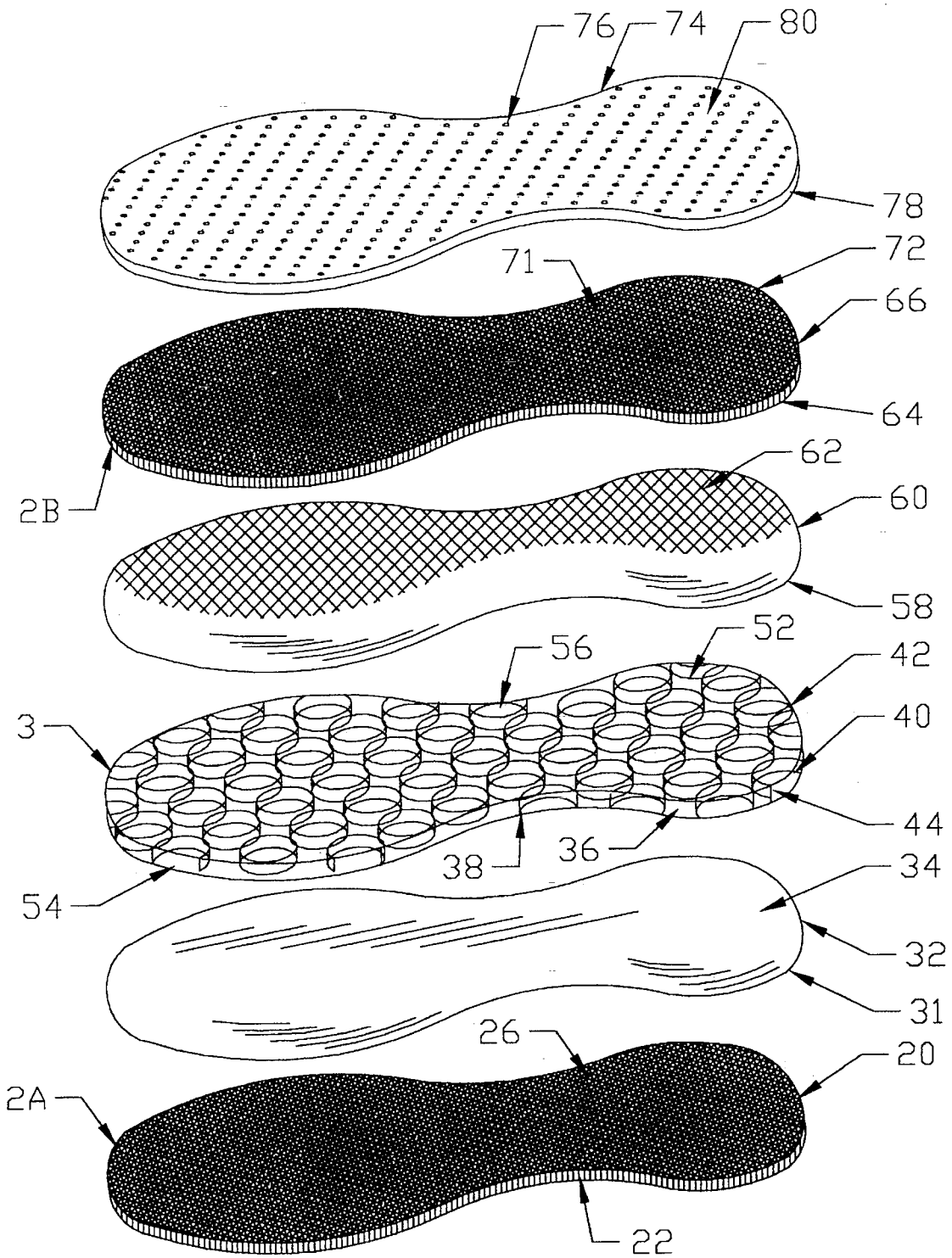
FIG. 1 is an exploded view of the insole.
Figure 2B:
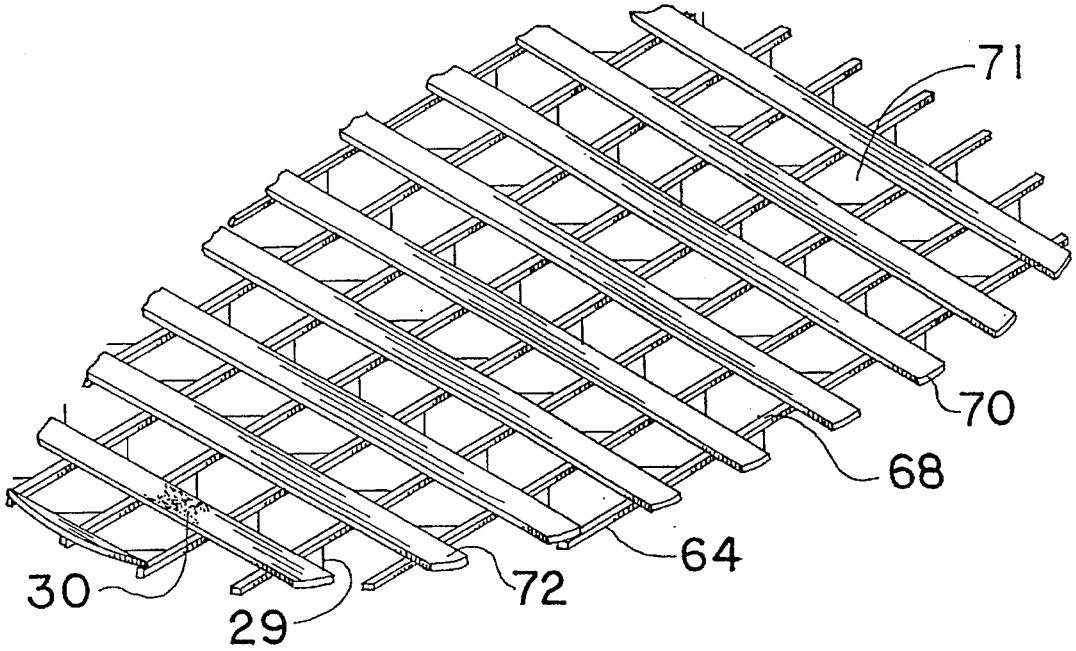
FIG. 2B is an enlarged view in the region of arrow 2A.
Figure 2A:
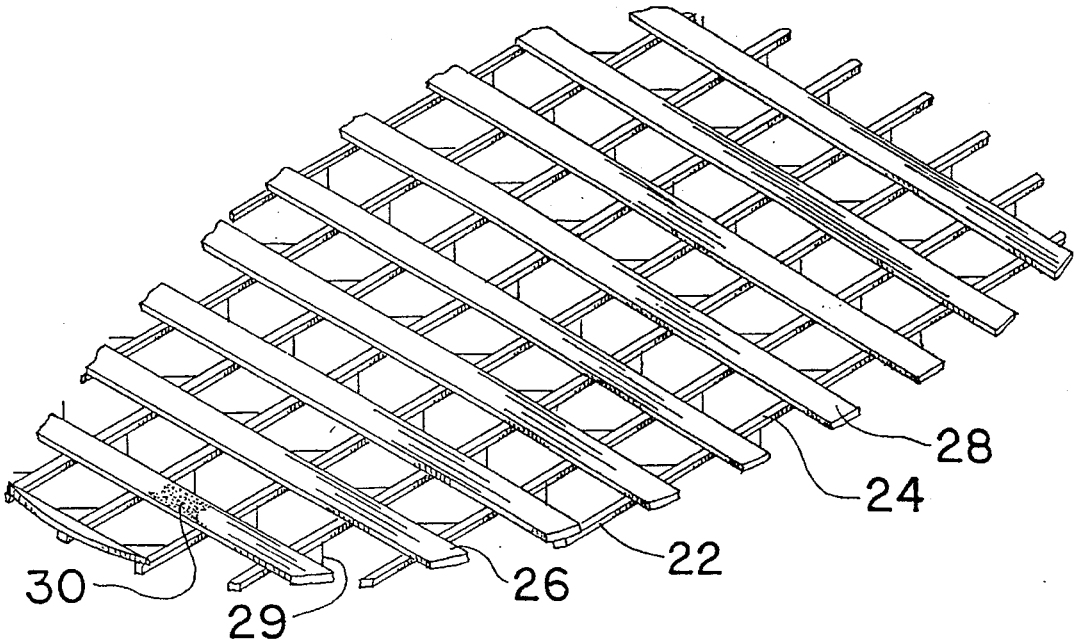
FIG. 2A is an enlarged view in the region of arrow 2.
Figure 4:
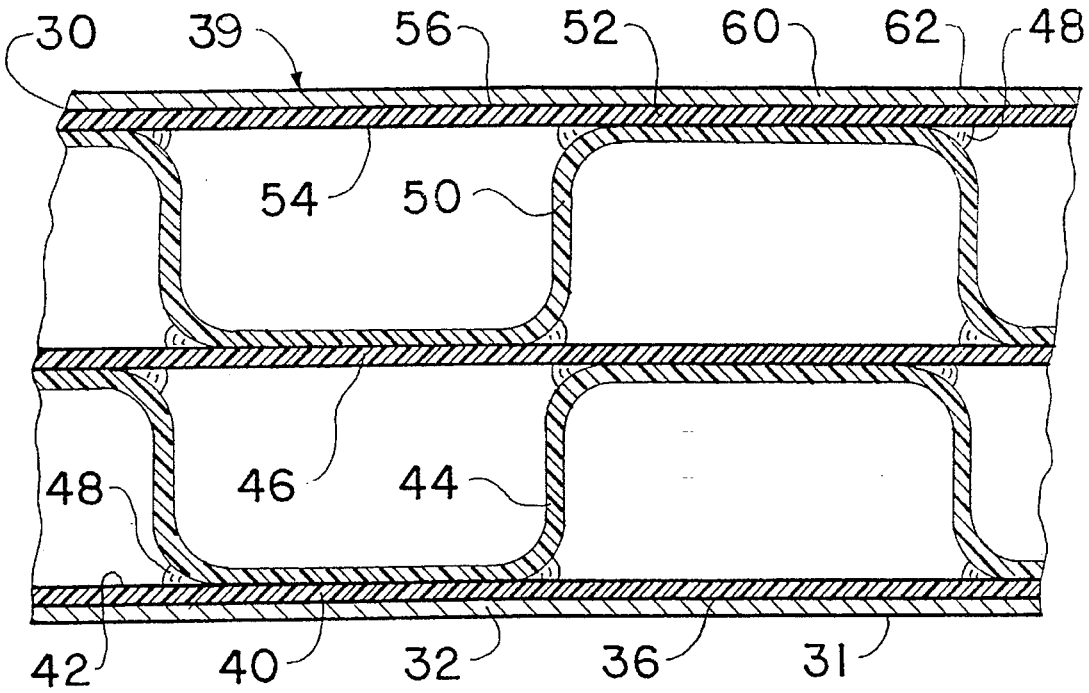
FIG. 4 is a view of an alternative to FIG. 3.
Figure 3:
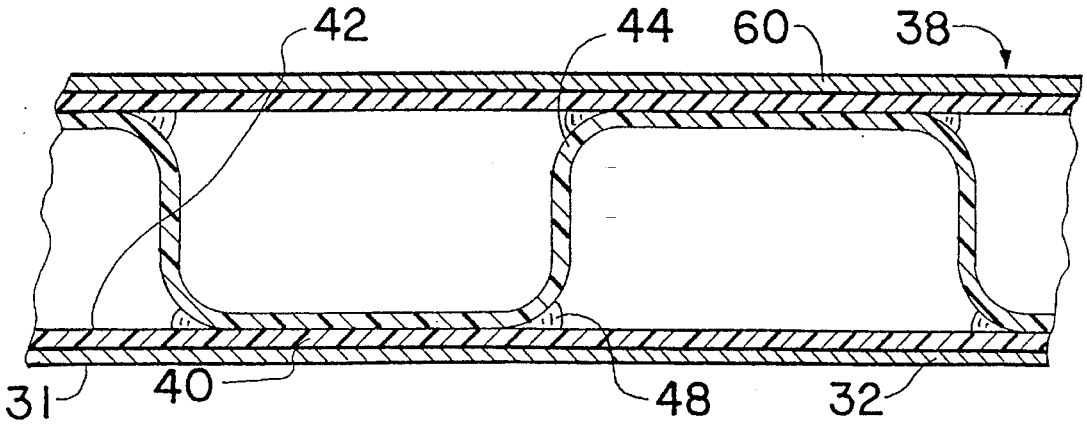
FIG. 3 is an enlarged view in the region of arrow 3.

A typical embodiment of the insole of the present invention is illustrated in FIG. 1 where one can see: a first mesh 20 composed of an interior face 22 made out of narrow thongs 24 (FIG. 2A) parallel, and an exterior face 26 made out of large thongs 28 parallel, placed perpendicularly to the narrow thongs 24, and fixed to the latter by means of thermowelding 29. The external face 26 is fixed, by adhesive means 30, to a first reflective face 31 (FIG. 3) of a first aluminum film 32 possessing a second opposed face 34 (FIG. 1) located at the back of the first reflective face 31 of the first aluminum film 32. The second opposed face 34 has a dull appearance and is fixed, at the time of the production of the aluminum by cold drawing, to a first polyethylene film 40 by cold laminating. The first aluminum film 32 forms the exterior of a double air bubble sandwich 39 (FIG. 4).

The air bubble sandwich 38 comes from a manufacturing process implicating lamination of two polyethylene films onto two aluminum foils: a first reflective face on the exterior side of an aluminum foil and a polyethylene film on the dull face of the aluminum foil and facing towards the interior of the sandwich; a second aluminum foil identical to the first and also having the reflective face towards the exterior with the polyethylene film on the dull face. Between the two aluminum foils, a double row of air bubbles separated in the center by a polyethylene film joining the two rows of air bubbles. The sandwich 38 comprises a first polyethylene film 40 having an internal face 36 and a first opposed contact face 42. A first series of air cells 44, having an approximative diameter of 10 mm, disposed at a rate of less than 1 air cell per $cm^2$ or less than 100 cells by square decimeter are fixed, by means of thermowelding 29, to the first opposed contact face 42. A second central film 46 joins, by means of thermowelding 48, the first series of cells 44 to a second series of cells 50. The latter is affixed onto a third polyethylene film 52, having a second opposed contact face 54 and an external face 56, by means of thermowelding 29, to the second opposed contact face 54. The external face 56 of the third polyethylene film 52, which is also the external face of the sandwich 38, is fixed, by adhesive means 30, onto a third face 58 (FIG. 1) of a second aluminum film 60 having a fourth reflective face 62 at the back of the third face 58. The fourth reflective face 62 is affixed, by adhesive means, onto a bottom face 64 of a second mesh 66.

There exists the possibility of utilising only one row of air cells in the sandwich (FIG. 3), or two rows (FIG. 4) in an amount of 1 to 10 cells to a $cm^2$. Nevertheless studies show that two rows of air cells (FIG. 4) are more effective and improve by far, the advantages of the present invention. The air cell sandwich can also be made of a spongy material that is comprised in a group of materials that include the following: Poron, spongy neoprene, latex, rubber, latex foam, viscolastic solid.

The second mesh 66 has a bottom face 64 (FIG. 2B) which comprises second narrow thongs 68 that are parallel and are fixed, by means of thermowelding 29, onto second large thongs 70, parallel between them and perpendicular to the second narrow thongs 68 forming thus the second ports 71. The second large thongs 70 constitute the top face 72 of the second mesh 66. The top face 72 is fixed, by adhesive means 30, onto an inferior face 78 of a fabric means. The mesh forms a netting having a size that can vary from 1 mm×1 mm to about 6 mm×6 mm.

The fabric means is a tissue 74 which also possesses a superior face 80 having a series of first orifices 76 permitting the ventilation of the insole. The orifices have an ideal diameter of 1 mm but can vary from 0.5 mm to 2 mm and represent an ideal area of 15% of the total area of the insole. The area is limited to 20% to prevent the insole from caving and not be able to support adequately the foot. Also the bigger the holes, the greater the risk of sweat touching the aluminum and, because of its acidity, causing rust to appear on the aluminum. The tissue 74 that rests under the foot can be made from a spongy material similar to the spongy material which may be used in the air cell sandwich above and which comprises the following materials: Poron, spongy neoprene, latex, rubber, latex foam, viscolastic solid. In the case where the spongy material is used, the air bubbles are disposed as in a sponge. The tissue which rests on the first mesh has a thickness not exceeding 6 mm and is constant on the whole of the length of the insole. The porosity resulting from the opened cells inside the tissue means, is constant over the whole volume of the tissue means. The elasticity of the tissue 74 corresponds to a 25/50 Durometer hardness.

In the process of laminating aluminum to polyethylene, the dull face of the aluminum film is fixed, by means of adhesive, onto a polyethylene film. The aluminum foil has a thickness that can vary from 0.005 mm to 0.1 mm and is made of aluminum having a purity level that can vary from 99.25% to 99.99%.

The bottom face 64 of first mesh 20 and the exterior face 26 of second mesh 66 are fixed respectively, by cold laminating, onto the fourth 62 and first 31 reflective faces of the aluminum foil.

Although the above description contains many specificities, these should not be construed as limiting the scope of the invention but as merely providing illustrations of some of the presently preferred embodiments of this invention.

Thus the scope of the invention should be determined by the appended claims and their legal equivalents, rather than by the examples given.

PARTS LIST

20. First mesh
22. Interior face
24. Narrow thong
26. Exterior face
28. Long thong
29. Thermowelding
30. Adhesive mean
31. First reflective face
32. First aluminum film
34. Second opposed face
36. Internal face
38. Air cell sandwich
39. Double air cell sandwich
40. First polyethylene film
42. First opposed contact face
44. First series of cells
46. Second central film
48. Thermowelding
50. Second series of cells
52. Third polyethylene film
54. Second opposed contact face
56. External face
58. Third face
60. Second aluminum film
62. Fourth reflective face
64. Bottom face
66. Second mesh
68. Second narrow thong
70. Second long thong
71. Second orifices
72. Top face
74. Tissue
76. First orifices
78. Interior face
80. Superior face

I claim:

1. A therapeutic and insulating insole to place on the inside of a footwear already having an interior sole adapted to receive the bottom of a foot, said therapeutic and insulating insole comprising in combination:

a first mesh comprising an interior face and an exterior face and composed of interlacing thongs to form said mesh, said interior face adapted to rest against said footwear interior sole, a first film made of an aluminum reflective material comprising a first reflective face and a second dull face opposed to said first face, said first reflective face being juxtapose to the exterior face of said first mesh by a transparent adhesive, a sandwich formed by air cells, said sandwich comprising two faces, one internal face and an external face, and comprising air cells juxtaposed throughout, said internal face comprising means for adhering to said second dull face, a second film made of a reflective material comprising two other faces one of which is a third face joined to said external face of said sandwich by a transparent adhesive and a fourth reflective face oriented in the opposite direction of said third face and adapted to receive and reflect heat emissions from the foot, a second mesh similar to said first mesh and comprising a bottom face and a top face, said bottom face joined to said fourth reflective face of said second film, a netting of said second mesh forming first orifices, a tissue comprising an inferior face and a superior face, said inferior face of said tissue juxtaposing said top face of said second mesh, said tissue having second orifices passing from said inferior face to said superior face and adapted to ventilate said tissue, said second orifices being located over said corresponding first orifices of said second mesh and allowing the passage of said heat emissions reflected by said fourth reflective face of said second film of reflective material through said first and second orifices and through said superior face of said tissue and allowing the simultaneous passage of heat emissions coming from said foot through said second and first orifices up to said second film of reflective material to be reflected toward said foot and conserve the heat.

2. An insole as defined in claim 1 wherein said second mesh comprises fixed parallel narrow thongs, joined by thermowelding to large parallel thongs, and placed perpendicularly to said narrow thongs, the resulting netting forming said first orifices adapted to allow air circulation to and from said reflective material.

3. An insole as defined in claim 2 wherein said narrow thongs are made of plastic and are fixed by adhesive to said fourth reflective face.

4. An insole as defined in claim 1 wherein said first orifices of said netting have a size varying from 1 mm×1 mm to about 6 mm×6 mm.

5. An insole as defined in claim 1 wherein said tissue possess the following characteristics:

a maximum thickness of 6 mm that is constant on the total length of the insole, a porosity formed by open cells inside said tissue, said porosity being constant everywhere in the insole having an elasticity corresponding to a 20/50 Durometer hardness.

6. An insole as defined in claim 1 wherein the quantity of said second orifices can vary up to a maximum of 15% of the total surface of the insole and whose diameter varies from 0.5 mm to 2 mm.

7. An insulating insole as defined in claim 1 wherein the reflective material is aluminum and comprises a reflective film and wherein the adhesive is transparent so as not to affect the reflectiveness of said reflective film of said aluminum.

8. An insole as defined in claim 7 wherein said second dull surface on said aluminum film is fixed by an adhesive, onto a polyethylene film.

9. An insole as defined in claim 7 wherein said bottom face and said exterior face of said second mesh and first mesh, respectively, are fixed by cold laminating, lamination onto said fourth and first reflective faces of said aluminum films.

10. An insole as defined in claim 7 wherein said aluminum film has a thickness that can vary from 0.005 mm 0.1 mm.

11. An insole as defined in claim 1 wherein said air cells are in a row.

12. An insole as defined in claim 11 wherein said row comprises a second identical row.

13. An insole as defined in claim 1 wherein said tissue comprise air cells made of a spongy material.

14. An insole as defined in claim 13 wherein said spongy material is comprised in a group of materials that include the following: Poron, spongy neoprene, latex, rubber, latex foam, viscolastic solid.

15. A method of fabrication of a therapeutic and insulating insole to be placed on the interior of a footwear already having a sole and adapted to receive the bottom face of a foot, said fabrication method comprising the following steps:

install a first mesh comprising an interior face and an exterior face and made out of interlaced thongs forming a netting, said interior face adapted to rest on said interior sole of said footwear, install a first aluminum film comprising a first reflective face and a second face opposed to said first face, said first reflective face juxtapose to said exterior face of said first mesh by a transparent adhesive, install a sandwich formed by air cells, said sandwich comprising two faces one of which is an internal face and the other is an external face, and comprising juxtaposed air cells, said internal face comprising means for adhering to said second opposed face of said first aluminum film by a transparent adhesive, install a second aluminum film comprising two other faces of which a third face joined to said external face of said sandwich by a transparent adhesive, and a fourth reflective face adapted to reflect the heat emissions from said foot, install a second mesh similar to said first mesh and comprising a bottom face and a top face, said bottom face of said second mesh joined to said fourth reflective face of said second aluminum film by a transparent adhesive, said netting of said second mesh forming first orifices, install a closed cell tissue comprising an inferior face and a superior face, said inferior face of said tissue juxtaposing said top face of said second mesh, said tissue having orifices passing from said inferior face to said superior face and adapted to ventilate said tissue, said second orifices being located in front of said corresponding first orifices of said second mesh and allowing the passage of said heat emissions reflected by said fourth reflective face of said second aluminum film through said first and second orifices all the way to a face of said foot, and permitting the simultaneous passage of heat emissions coming from the face of said foot through said second and first orifices to the second aluminum film to reflect toward said foot and therefore keep in warmth.

16. A construction method as defined in claim 15 wherein said juxtaposed air cells are in a quantity of 1 to 10 per $cm^2$.

17. A construction method as defined in claim 15 wherein said juxtaposed air cells are disposed as in a sponge.

18. A construction method as defined in claim 15 wherein said aluminum film is made of aluminum having a purity that can vary from 99.25% to 99.99%.

* * * * *